US006179292B1

(12) United States Patent
Aramapakul

(10) Patent No.: US 6,179,292 B1
(45) Date of Patent: Jan. 30, 2001

(54) METHOD OF PLAYING A TARGET NUMERICAL SUM GAME

(76) Inventor: Paiboon Aramapakul, 4067 Hardwick St. Suite #108, Lakewood, CA (US) 90712

( * ) Notice: Under 35 U.S.C. 154(b), the term of this patent shall be extended for 0 days.

(21) Appl. No.: 09/159,206

(22) Filed: Sep. 23, 1998

(51) Int. Cl.[7] ..... A63F 1/00
(52) U.S. Cl. ..... 273/292; 273/274
(58) Field of Search ..... 273/274, 292; 463/12, 13, 16

(56) References Cited

U.S. PATENT DOCUMENTS 5,397,128 * 3/1995 Hesse et al. .
5,632,485 * 5/1997 Woodland et al. .
5,636,843 * 6/1997 Roberts .
5,673,917 * 10/1997 Vancura .
5,791,989 * 8/1998 Slinkman .
5,799,945 * 9/1998 Boylan et al. .
5,806,846 * 9/1998 Lofink et al. .
5,816,575 * 10/1998 Keller .

* cited by examiner

*Primary Examiner*—William M. Pierce
(74) *Attorney, Agent, or Firm*—Ted Masters

(57) ABSTRACT

A method of playing a wagering game (20) includes a target numerical sum game to which is added the step of placing a supplemental wager that a player's cards will be of the same suit. In one embodiment (20) only the player's first two cards must be of the same suit in order to win. In another embodiment (120) either the player or the banker wins if all of his/her cards are the same suit and he/she wins also the conventional target numerical sum game. This principles of the present invention may be practiced with any target numerical sum game such as conventional Blackjack, California Blackjack, Baccarat etc.

4 Claims, 5 Drawing Sheets

20
22
START OF A ROUND OF PLAY
24
A PLAYER PLACING A SUPPLEMENTAL WAGER THAT THE PLAYER'S FIRST TWO CARDS WILL BE THE SAME SUIT
26
PLAYING A TARGET NUMERICAL SUM-TYPE GAME IN ACCORDANCE WITH ESTABLISHED RULES OF PLAY
28
ARE THE PLAYER'S FIRST TWO CARDS THE SAME SUIT?
YES
NO
30
THE PLAYER RECEIVING A PAYOFF
32
THE PLAYER LOSING THE SUPPLEMENTALWAGER
34
END OF A ROUND OF PLAY

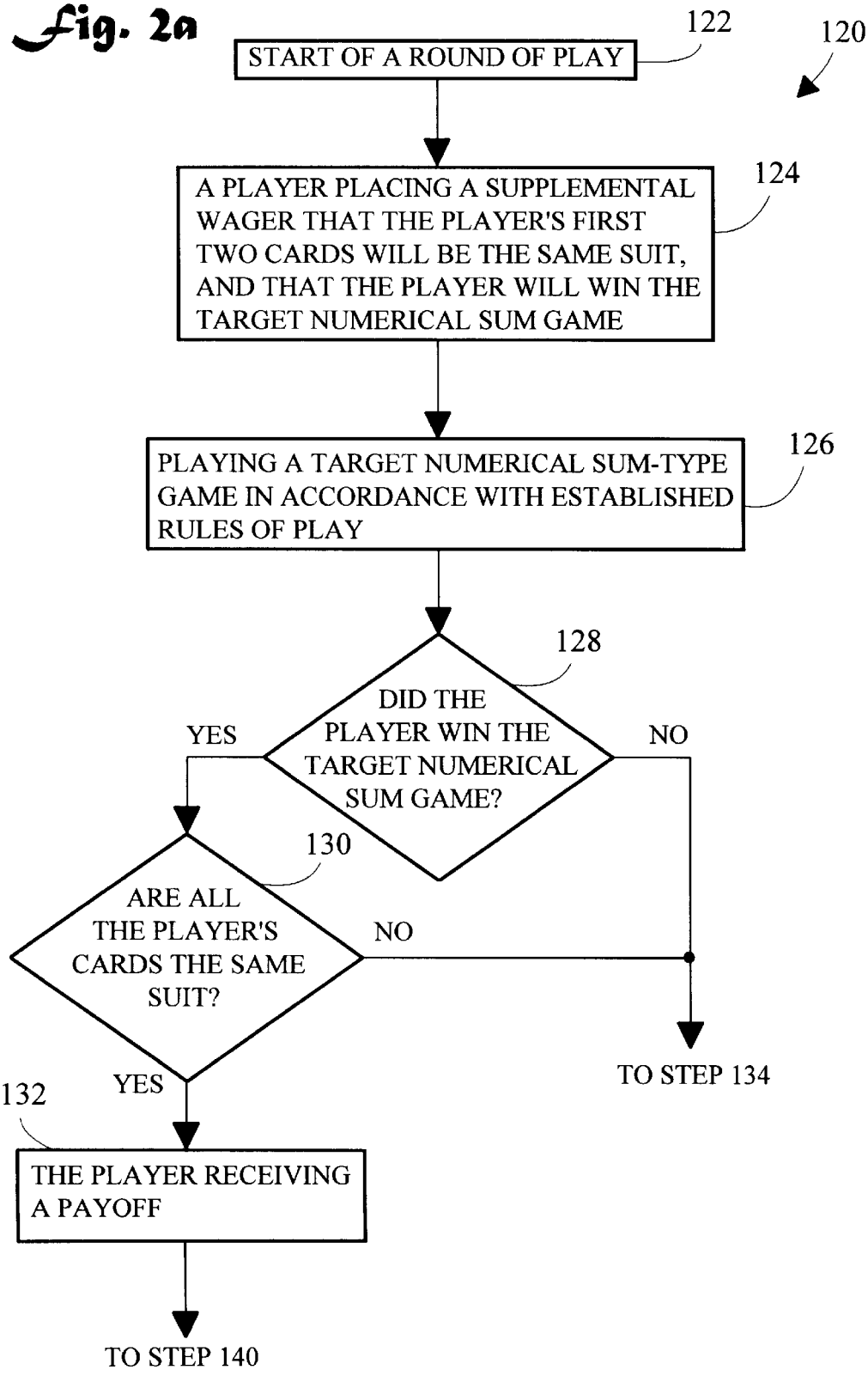
Fig. 2a
120
122
START OF A ROUND OF PLAY
124
A PLAYER PLACING A SUPPLEMENTAL WAGER THAT THE PLAYER'S FIRST TWO CARDS WILL BE THE SAME SUIT, AND THAT THE PLAYER WILL WIN THE TARGET NUMERICAL SUM GAME
126
PLAYING A TARGET NUMERICAL SUM-TYPE GAME IN ACCORDANCE WITH ESTABLISHED RULES OF PLAY
128
DID THE PLAYER WIN THE TARGET NUMERICAL SUM GAME?
YES
NO
130
ARE ALL THE PLAYER'S CARDS THE SAME SUIT?
NO
TO STEP 134
YES
132
THE PLAYER RECEIVING A PAYOFF
TO STEP 140

120
FROM STEPS 128, 130
134
DID THE BANKER WIN THE TARGET NUMERICAL SUM GAME?
YES
NO
136
ARE ALL THE BANKER'S CARDS THE SAME SUIT?
NO
YES
138
THE BANKER RECEIVING A PAYOFF
FROM STEP 132
140
END OF A ROUND OF PLAY

METHOD OF PLAYING A TARGET NUMERICAL SUM GAME

TECHNICAL FIELD

The present invention pertains to card games in general, and in particular to card games wherein the objective is to achieve an established target numerical sum, such as the game of Blackjack.

BACKGROUND ART

Target numerical sum games are well known in the art. For example in the game of Blackjack, the cards have established numerical values, such as ace equals one or eleven, face cards equal ten, and other cards equal to their face values (e.g. a two has a numerical value of two, a three has a numerical value of three, etc.). A player tries to reach an established target numerical sum of 21 by sequentially accumulating cards and totaling their numerical values. Two cards are initially dealt, and the player then has the option of requesting and receiving one or more additional cards ("hits"). A player wins a wager if the final numerical sum of the player's cards is less than or equal to 21 and is closer to 21 than the numerical sum of the dealer's cards. If the numerical sum of the player's cards exceeds 21, the player's hand is a "bust", and the wager is lost.

In certain states, such as California, Blackjack is illegal. Therefore, other similar Blackjack-type games have been devised. One such game is "California Blackjack" (U.S. Pat. No. 5,275,415) wherein the established target numerical sum is 22. A player tries to get closer to 22 than the dealer (usually a "player banker"). If the player's numerical sum exceeds 22 the hand is not a bust. Similarly, in the game of "LA Blackjack" the object of the game is to reach a target numerical sum of 22.

Another type of target numerical sum game is Baccarat (called "Jumping Jack" in Asia). In this game the objective is to achieve a target numerical sum of nine. The cards have established numerical values of ace equals one, face cards equal zero, and other cards equal to their face values (e.g. a two has a numerical value of two, a three has a numerical value of three, etc.). A player initially receives two cards, and may at his/her option receive one, and only one, additional card. If the total of the numerical sum of the player's cards exceeds nine, then the ten is subtracted to result in the final numerical sum.

Other established target numerical sums are of course also possible. For example, in U.S. Pat. No. 5,549,300 the target numerical sum is 20. In fact, any target numerical sum that is consistent with the established numerical values of the cards may be used.

DISCLOSURE OF INVENTION

The present invention is directed to an improved method of playing any target numerical sum game, such as conventional Blackjack (21), California Blackjack, Baccarat, etc. The present invention simply adds the step of placing a supplemental wager that a player's cards will be of the same suit. The same suit wager is in addition to the conventional wager(s) of the target numerical sum game. The target numerical sum game is then played in accordance with established rules of play. If the player's cards are the same suit, the player receives a payoff. In one embodiment of the present invention, the player wins if his/her first two cards are of the same suit. In another embodiment, all of the player's or bankers cards must be the same suit, and the player or banker must also win the target numerical sum game in order for that individual to win. A preferred name for the present invention is COLOR JACK.

In accordance with a preferred embodiment of the invention, a method of playing a target numerical sum game comprises, a player placing a supplemental wager that the player's first two cards will be the same suit. The target numerical sum game is then played in accordance with established rules of play. The player receives a payoff if his/her first two cards are the same suit. The payoff may either be made before or after the completion of the target numerical sum game.

In accordance with an important aspect of the invention, the target numerical sum game has a target numerical sum of one of 21, 22, 20, and 9.

In accordance with another preferred embodiment of the invention, a player places a supplemental wager that (1) all of the player's cards will be of the same suit, and also that (2) the player will win the target numerical sum game. The target numerical sum game is then played in accordance with established rules of play. The player receives a payoff if all of the player's cards are of the same suit and also the player wins the target numerical sum game. Conversely, the banker receives a payoff if all of the banker's cards are of the same suit and also the banker wins the target numerical sum game. If neither the player nor the banker has all cards of the same suit and also wins the target numerical sum game, the supplemental wager is a push.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
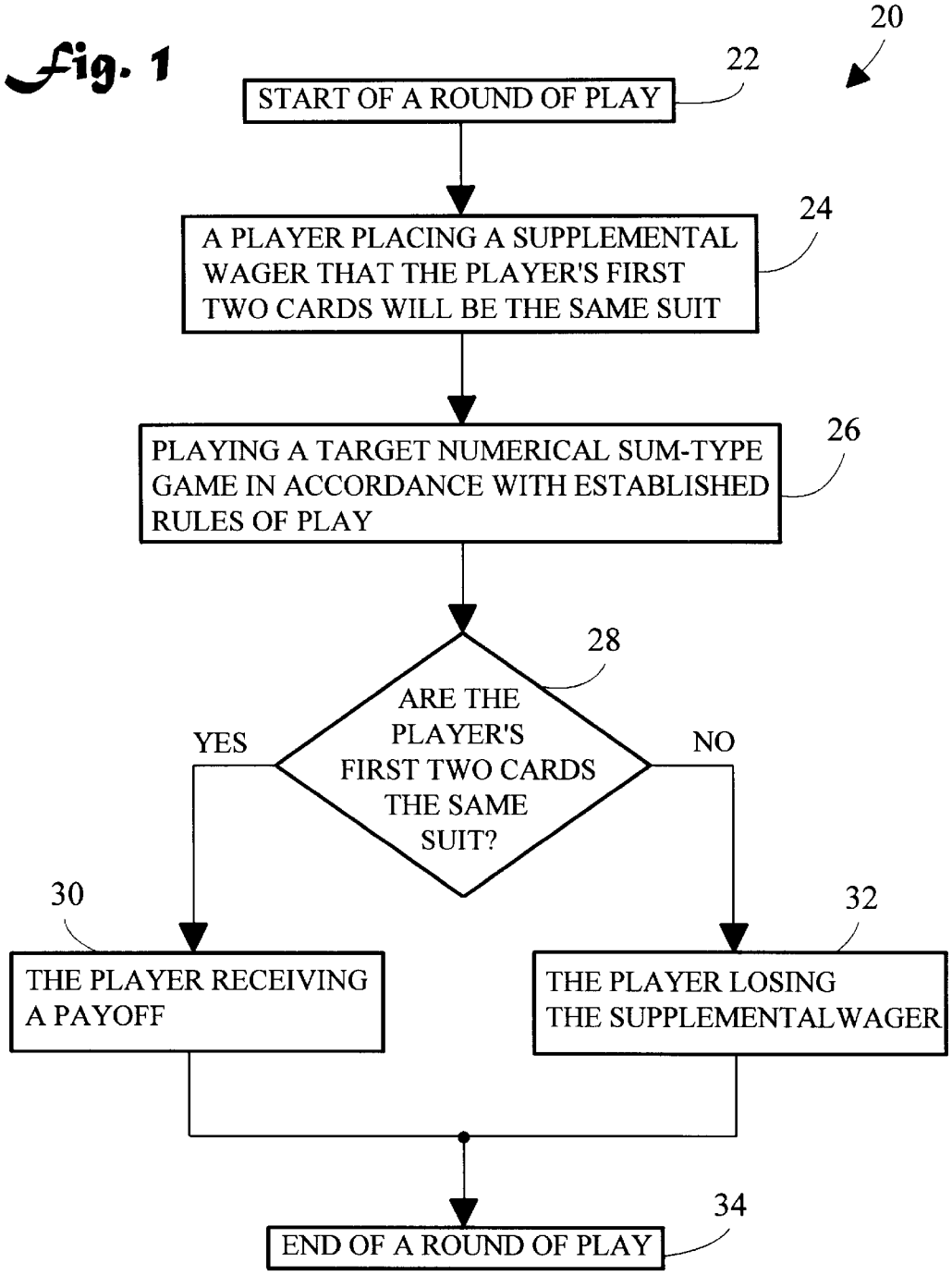
FIG. 1 is a flow diagram illustrating the steps and method of play of a target numerical sum game in accordance with the present invention.

Referring initially to FIG. 1, there is depicted a flow diagram illustrating the steps and method of play of a target numerical sum wagering game in accordance with the present invention, generally designated as 20. Wagering game 20 comprises an existing target numerical sum-type game such as Blackjack, Baccarat, etc., to which is added the improved method of the present invention. As used herein, the term existing "target numerical sum-type game" includes any game in which a player receives two initial cards, and then has the option of accumulating additional cards in the form of "hits" in an attempt to reach a target numerical sum, such as 20, 21, 22, 9, etc. Each of the cards has a pre-established numerical value which are added to determine the final numerical sum of the player's hand. The games of conventional Blackjack (target numerical sum 21), California Blackjack (target numerical sum 22), Baccarat(target numerical sum 9) or any other game having this general target numerical sum playing format are intended to be included in the target numerical sum-type game category. Additionally, these target numerical sum-type games may be played using a variety of established rules of play such as, but not limited to, (1) different target numerical sums, (2) the cards being dealt either face up or face down, (3) use of one or multiple jokers, (4) played with one deck or multiple decks, (5) various payoff amounts, (6) special house rules, etc.

Game 20 is played by one or more players who each play against either a house dealer or a player banker, collectively referred to herein as the "banker". A round of play of game 20 begins with start terminator step 22. In step 24 a player places a supplemental wager that the player's first two cards will be the same suit (either both spades, both hearts, both diamonds, or both clubs). It is noted that the supplemental wager placed in step 24 is in addition to the conventional wager placed on the outcome of the target numerical sum game. In step 26 a target numerical sum-type game is played in accordance with established rules of play. In step 28 it is determined if the player's first two cards are the same suit. If the player's first two cards are the same suit (YES), in step 30 the player receives a payoff amount which is determined by the gaming establishment. Since the odds of the player's first two cards being the same suit are 3 to 1 against, a payoff of less than or equal to 3 to 1 would be reasonable, however the exact payoff would be determined by the gaming establishment. If the player's first two cards are not the same suit (NO), in step 32 the player loses his/her supplemental wager to the banker. A round of play is then concluded in end terminator step 34. It is noted that the existing target numerical sum-type game comprises step 26, while the improved method of the present invention comprises steps 22, 24, 28, 30, 32 and 34. It is further noted, that in an alternative embodiment the supplemental wager may be settled after the first two cards are dealt by the dealer in the target numerical sum-type game, but prior to completing the balance of play of the target numerical sum-type game.

Figure 2B:
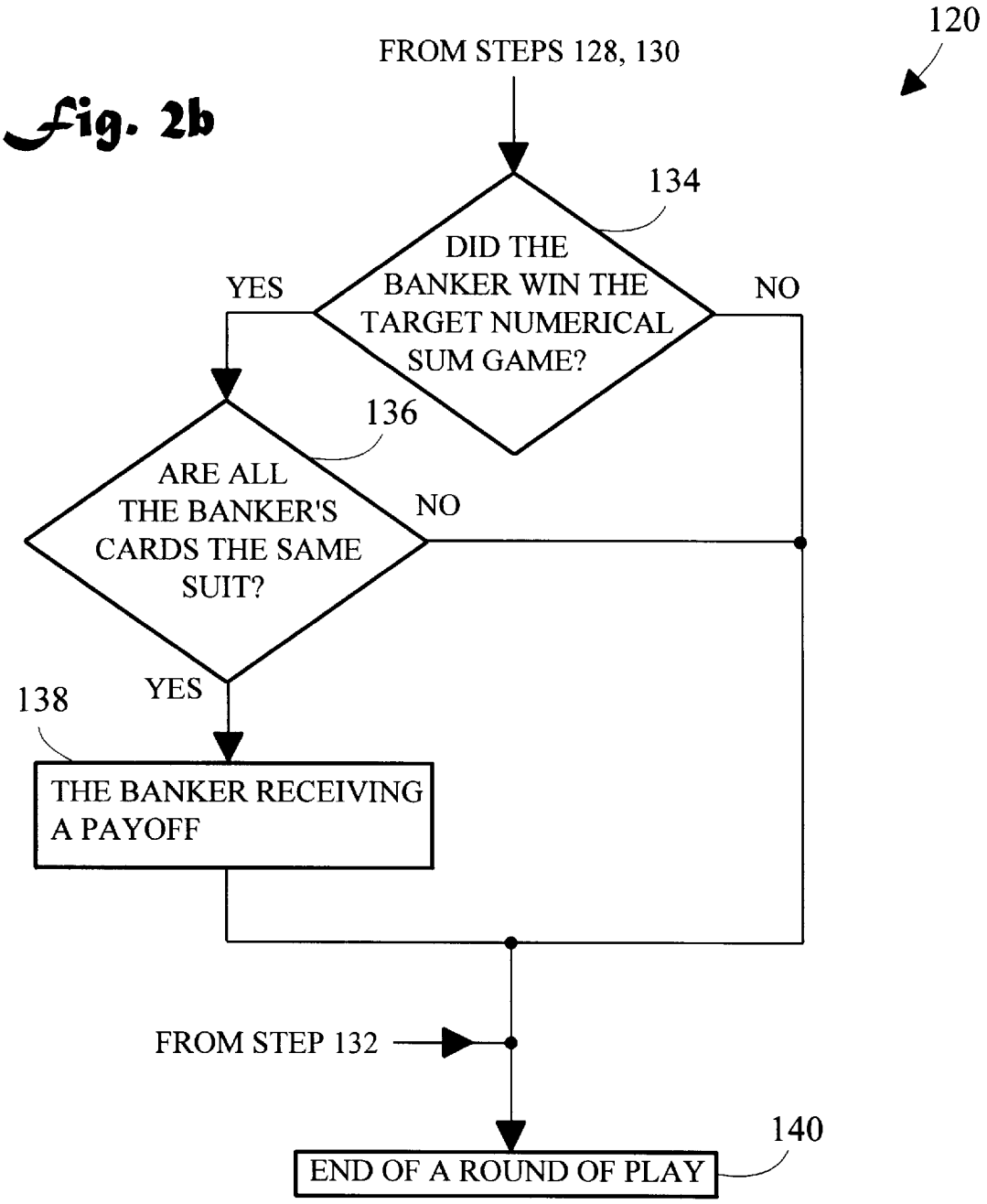
FIG. 2 is a flow diagram illustrating a second embodiment.

FIG. 2 is a flow diagram of a second embodiment of the present invention, generally designated as 120. Wagering game 120 is played by one or more players who each play against either a house dealer or a player banker, collectively referred to herein as the "banker". A round of play of game 120 begins with start terminator step 122. In step 124 a player places a supplemental wager that (1) all of the player's cards will be of the same suit, and also that (2) the player will win the target numerical sum game. That is, the player is wagering that all of the player's cards (initial cards plus hits) will be of the same suit, and that the player will win the target numerical sum game, before the banker accomplishes this same goal. It is noted that the supplemental wager placed in step 124 is in addition to the conventional wager placed on the outcome of the target numerical sum game. In step 126 a target numerical sum-type game is played in accordance with established rules of play. In step 128 it is determined if the player won the target numerical sum game. If YES in step 128, in step 130 it is determined if all of the player's cards are the same suit. If YES is step 130, in step 132 the player receives a payoff, and the round of play is concluded in end terminator 140. If in either steps 128 or 130 the answer is NO, play proceeds to step 134 where it is determined if the banker won the target numerical sum game. If YES in step 134, in step 136 it is determined if all of the banker's cards are the same suit. If YES in step 136, in step 138 the banker receives a payoff. If in either steps 134 or 136 the answer is NO, the supplemental wager is a push and the round of play is concluded in end terminator 140.

As can be appreciated from the above discussion, the player in game 120 is placing a supplemental wager that he/she will satisfy both criterion (i.e. all cards of the same suit and winning the target numerical sum game) before the banker does so. The first individual to satisfy both criteria wins the supplemental wager in the form of a payoff.

It is noted that if neither the player nor the banker has all cards of the same suit and also wins the target numerical sum game, the supplemental wager is a push.

The payoff in game 120 is determined by the gaming establishment. In one possible variation the payoff is determined by how many cards the winning player has at the end of the game. For example, if the winner (player or banker) has exactly two cards, the payoff would be 2 to 1. That is, if the player placed a $10 wager, the payoff would be $20. If the winner has exactly three cards, the payoff would be 3 to 1. If the winner has exactly four cards, the payoff would be 4 to 1. If the winner has exactly five cards, the payoff would be 5 to 1.

In a preferred embodiment of game 120, the banker does not win the supplemental wager if he/she exceeds the target numerical sum (busts). In another possible playing embodiment the banker would win the supplemental wager if he/she exceeds the target numerical sum (busts). Similarly for games such as California Blackjack where there is no bust, in accordance with gaming establishment rules, the player or the banker could either win or be prohibited from winning if his/her numerical sum exceeds the target value of 22.

It is further noted that, in the game of Blackjack, if a player splits a pair, he/she may make a second supplemental wager to cover the second hand. Also it is noted that both embodiments 20 and 120 of the present invention may be played simultaneously.

The following examples serve to illustrate the principles of wagering game 120 as applied to the target numerical sum game of Blackjack:

EXAMPLE 1

The player is initially dealt the two of spades and the six of spades, and hits the ten of spades. (final total 18)

The banker is initially dealt the six of diamonds and the four of hearts, and hits the seven of hearts. (final total 17)

Result: The player wins the Blackjack game. Since all of the player's cards are the same suit (spades) and the player won the Blackjack game, the player also wins the supplemental wager in the form of a payoff.

EXAMPLE 2

The player is initially dealt the two of spades and the six of spades, and hits the ten of clubs. (final total 18)

The banker is initially dealt the six of diamonds and the four of hearts, and hits the seven of hearts. (final total 17)

Result: The player wins the Blackjack game. Since all of the player's cards are not the same suit the supplemental wager is a push.

EXAMPLE 3

The player is initially dealt the two of spades and the six of spades, and hits the ten of spades. (final total 18)

The banker is initially dealt the six of diamonds and the four of hearts, and hits the nine of hearts. (final total 19)

Result: The player loses the Blackjack game. Even though all of the player's cards are the same suit (spades), the player does not win the supplemental wager since he/she did not win the Blackjack game. The supplemental wager is a push.

EXAMPLE 4

The player is initially dealt the two of spades and the six of spades, and hits the ten of spades. (final total 18)

The banker is initially dealt the six of diamonds and the four of diamonds, and hits the nine of diamonds. (final total 19)

Result: The banker wins the Blackjack game. Since all of the banker's cards are the same suit (diamonds) and the banker won the Blackjack game, the banker also wins the supplemental wager.

EXAMPLE 5

The player is initially dealt the two of spades and the six of spades, and hits the ten of spades. (final total 18)

The banker is initially dealt the six of diamonds and the four of hearts, and hits the eight of hearts. (final total 18)

Result: The player pushes (ties) the Blackjack game. Even though all of the player's cards are the same suit (spades), the supplemental wager is a push since the player only pushed but did not win the Blackjack game.

EXAMPLE 6

The player is initially dealt the six of spades and the eight of spades, and hits the ten of spades. (final total 24, BUST)

The banker is initially dealt the six of diamonds and the four of hearts, and hits the seven of hearts. (final total 17)

Result: The banker wins the Blackjack game. Even though all of the player's cards are the same suit (spades), the supplemental wager is a push since the player did not win the Blackjack game.

EXAMPLE 7

The player is initially dealt the six of spades and the eight of spades, and hits the ten of spades. (final total 24, BUST)

The banker is initially dealt the six of diamonds and the nine of hearts, and hits the seven of hearts. (final total 22, BUST)

Result: The banker wins the Blackjack game since the player busted first.

However, in a preferred paying embodiment of the present invention, the banker cannot win the supplemental wager if he/she busts. Therefore, the supplemental wager is a push.

The following examples serve to illustrate the principles of wagering game 120 as applied to the game of target numerical sum game of Baccarat:

EXAMPLE 8

The player is initially dealt the six of spades and the two of spades, and does not take a hit. (final total 8)

The banker is initially dealt the two of hearts and the five of hearts, and does not take a hit. (final total 7)

Result: The player wins the Baccarat game. Since the player's two cards are of the same suit, the player also wins the supplemental wager.

EXAMPLE 9

The player is initially dealt the six of spades and the king of spades, and hits the three of spades. (final total 9)

The banker is initially dealt the two of hearts and the five of hearts, and does not take a hit. (final total 7)

Result: The player wins the Baccarat game. Since the player's three cards are of the same suit, the player also wins the supplemental wager.

EXAMPLE 10

The player is initially dealt the six of spades and the jack of spades, and hits the three of diamonds. (final total 9)

The banker is initially dealt the two of hearts and the five of hearts, and does not take a hit. (final total 7)

Result: The player wins the Baccarat game. Since the player's three cards are not all of the same suit, the supplemental wager is a push.

EXAMPLE 11

The player is initially dealt the six of spades and the jack of spades, and hits the two of diamonds. (final total 8)

The banker is initially dealt the two of hearts and the seven of hearts, and does not take a hit. (final total 9)

Result: The banker wins the Baccarat game. Since the banker's two cards are all of the same suit, the banker also wins the supplemental wager.

EXAMPLE 12

The player is initially dealt the six of spades and the jack of spades, and hits the three of spades. (final total 9)

The banker is initially dealt the two of hearts and the seven of diamonds, and does not take a hit. (final total 9)

Result: The Baccarat game is a push. Since the player did not win the Baccarat game, the supplemental wager is a push.

Figure 3:
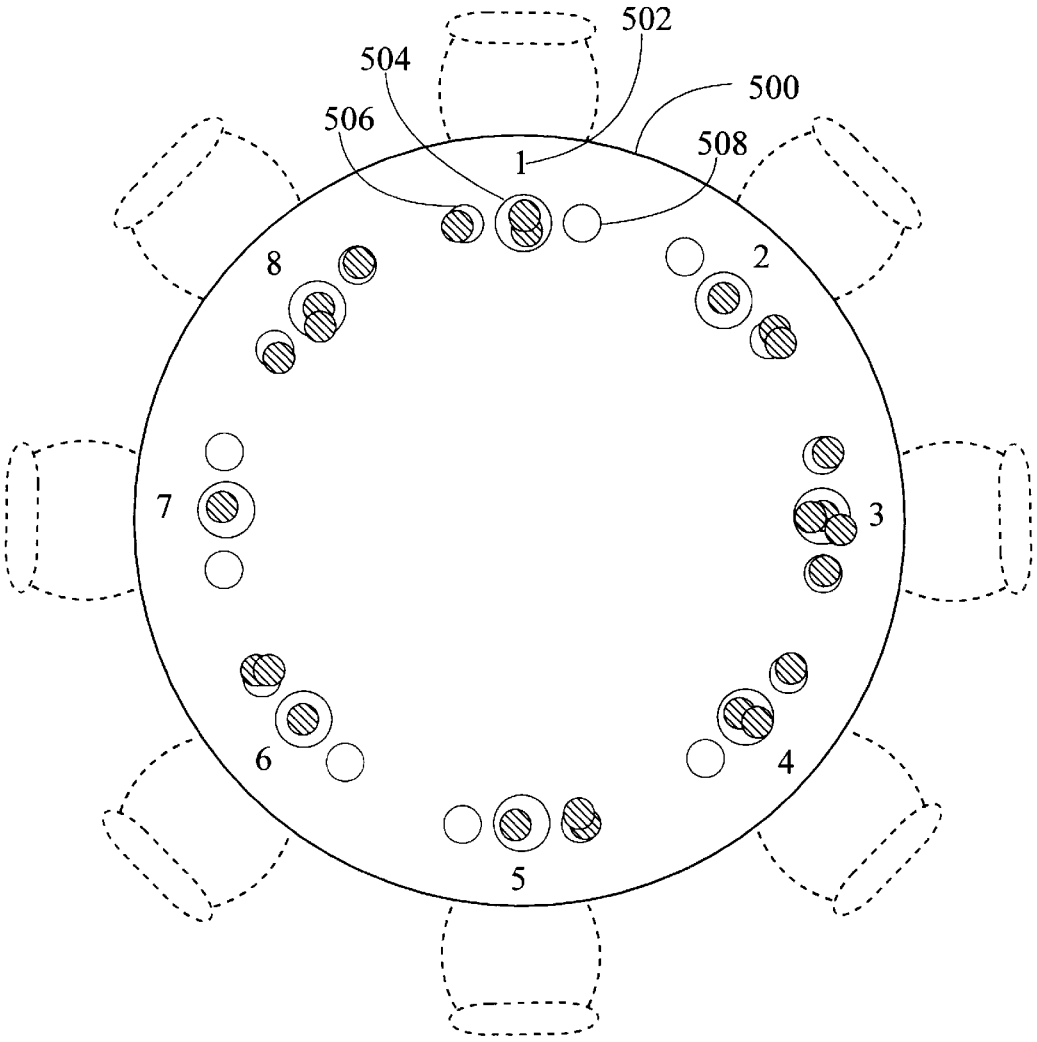
FIG. 3 is a plan view of a playing table layout.

FIG. 3 is a plan view of a playing table layout. Playing table 500 includes a plurality of playing positions 502, eight in the shown embodiment. This playing table layout is most compatible with a target numerical sum-type game in which a plurality of players play against a player banker. Indicia depicting three wagering areas 504, 506, and 508, playing positions 502, or other pertinent information can be disposed upon the surface of playing table 500 or a covering thereof. Wagering area 504 is used to place conventional wagers or bets in the target numerical sum-type game. Wagering areas 506 and 508 are used to place supplemental wagers in accordance with the teachings of the present invention. For example, wagering area 506 can be used to place the wagers of wagering game 20 as defined herein, and wagering area 508 can be used to place the wagers of wagering game 120 also as defined herein.

Figure 4:
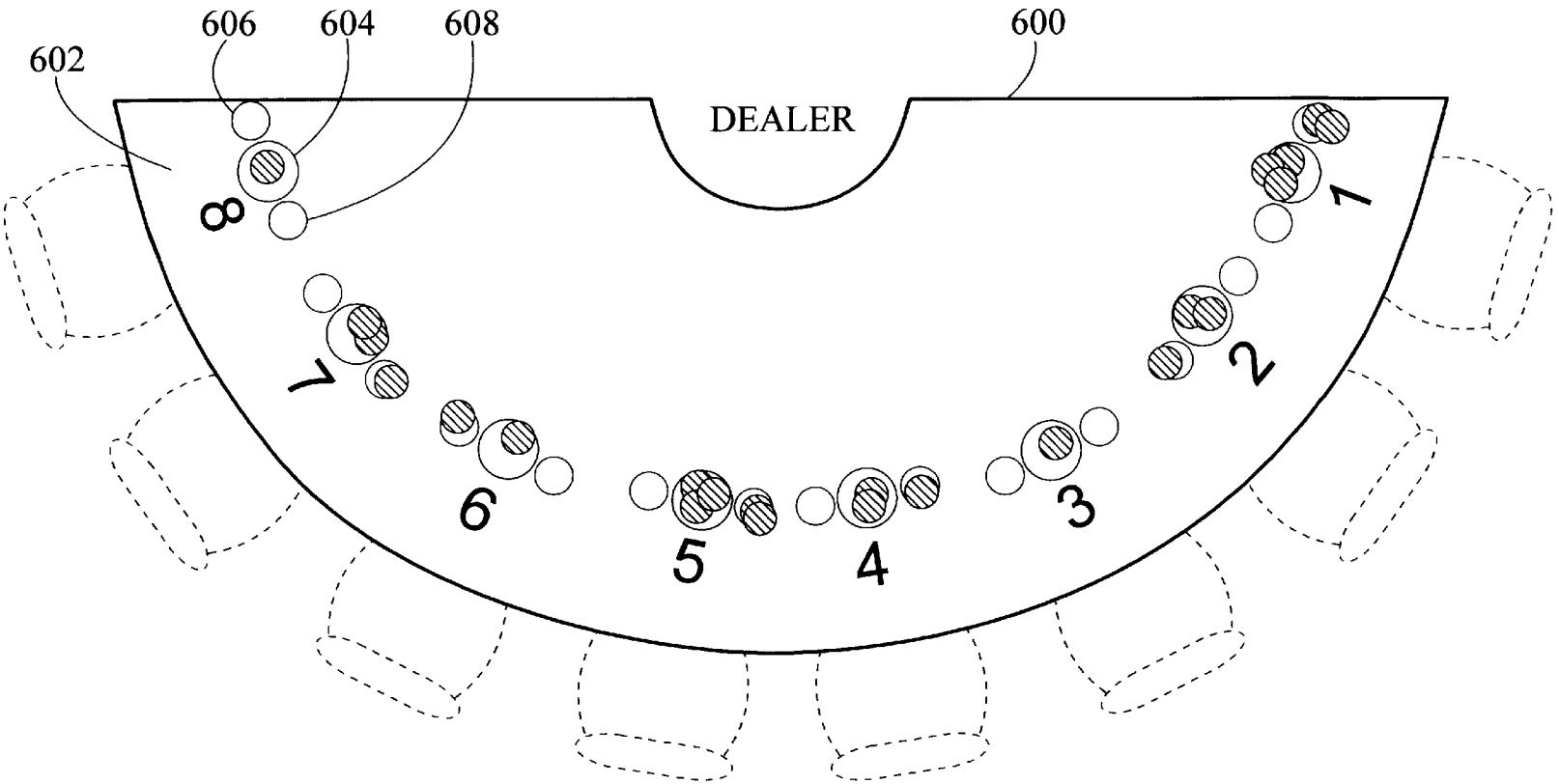
FIG. 4 is a plan view of a second playing table layout.

FIG. 4 is a plan view of a second playing table layout. Playing table 600 includes a plurality of playing positions 602, eight plus a dealer in the shown embodiment. This playing table layout is most compatible with a target numerical sum-type game in which a plurality of players play against a house dealer. Indicia depicting three wagering areas 604, 606, and 608, playing positions 602, or other pertinent information can be disposed upon the surface of playing table 600 or a covering thereof. Wagering area 604 is used to place conventional wagers or bets in the target numerical sum-type game. Wagering areas 606 and 608 are used to place supplemental wagers in accordance with the teachings of the present invention. For example, wagering area 606 can be used to place the wagers of wagering game 20 as defined herein, and wagering area 608 can be used to place the wagers of wagering game 120 also as defined herein.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An improved method of playing a target numerical sum game between a player and a banker in which a player places a conventional wager on an outcome of the target numerical sum game, and the target numerical sum game is played in accordance with established rules of play in which the player receives a first round of cards and optional subsequent rounds of cards, wherein the improvement comprises:

prior to the first round of cards the player placing a supplemental wager that (1) all of the player's cards will be of a same suit, and also that (2) the player will win the target numerical sum game;

the player receiving a payoff if all of the player's cards are of the same suit and also the player wins the target numerical sum game; and, a banker receiving a payoff if all of the banker's cards are of the same suit and also the banker wins the target numerical sum game.

2. The method according to claim 1, wherein if neither the player nor the banker has all cards of the same suit and also wins the target numerical sum game, said wager is a push.

3. The method according to claim 1, the target numerical sum game having a target sum of one of 21, 22, 20, and 9.

4. The method according to claim 1, wherein (1) said payoff is 2 to 1 if a winner has exactly two cards, (2) said payoff is 3 to 1 if the winner has exactly three cards, (3) said payoff is 4 to 1 if the winner has exactly four cards, and (4) said payoff is 5 to 1 if the winner has exactly five cards.

* * * * *